United States Patent [19]

Tiitola

[11] 3,982,760

[45] Sept. 28, 1976

[54] STICK FOR HOCKEY OR THE LIKE

[75] Inventor: Antti-Jussi Tiitola, Tampere, Finland

[73] Assignee: Karhu-Titan Oy, Finland

[22] Filed: Nov. 26, 1974

[21] Appl. No.: 527,448

[30] Foreign Application Priority Data

Dec. 13, 1973 Finland ..... 3837/73

[52] U.S. Cl. ..... 273/67 A

[51] Int. Cl.[2] ..... A63B 59/14

[58] Field of Search ..... 273/67 R, 67 A, 67 D, 273/73 F, 81.4–81.6, 167 R, 167 A, DIG. 1–DIG. 12, 82 B, 82 R, 174; 280/11.12, 11.13 R, 11.13 E, 11.13 L, 11.13 V, 11.18; 156/91, 92

[56] References Cited

UNITED STATES PATENTS

| | | | |
|---|---|---|---|
| 1,017,565 | 2/1912 | Lard | 273/81.6 |
| 2,304,322 | 12/1942 | Werlich | 273/67 A |
| 2,428,325 | 9/1947 | Collins | 273/73 F X |
| 2,851,277 | 9/1958 | Holmberg et al. | 280/11.13 L |
| 3,444,568 | 5/1969 | Vogelsang | 273/67 R X |
| 3,529,825 | 9/1970 | White | 273/67 A |
| 3,533,623 | 10/1970 | Dumont | 273/67 A |

FOREIGN PATENTS OR APPLICATIONS

| | | | |
|---|---|---|---|
| 591,454 | 1/1960 | Canada | 273/67 A |
| 42,515 | 4/1970 | Finland | 273/67 A |
| 21,920 | 8/1947 | Finland | 273/67 A |
| 56,706 | 6/1936 | Norway | 273/67 D |
| 272,851 | 3/1970 | U.S.S.R. | 273/67 A |
| 744,778 | 2/1956 | United Kingdom | 273/67 D |
| 846,673 | 8/1960 | United Kingdom | 273/67 A |
| 932,221 | 7/1963 | United Kingdom | 273/67 D |
| 272,851 | 3/1970 | U.S.S.R. | 273/67 A |

*Primary Examiner*—Richard J. Apley
*Attorney, Agent, or Firm*—Steinberg & Blake

[57] ABSTRACT

A stick to be used for ice hockey or the like. The stick is composed of a plurality of inner core pieces to the exterior of which reinforced plastic layers are laminated. Along the bottom of the blade of the stick is a hard-wearing core piece which extends downwardly beyond the layers laminated thereto so as to be exposed at the bottom edge of the blade for directly engaging the ice or the like. The several core pieces have only flat end surfaces engaging each other, so that they are not joined by tongue-and-groove joints or the like, and these core pieces may be held together at least temporarily by fasteners such as staples so that the assembled core pieces can then have the outer layers of reinforced plastic laminated thereto.

12 Claims, 3 Drawing Figures

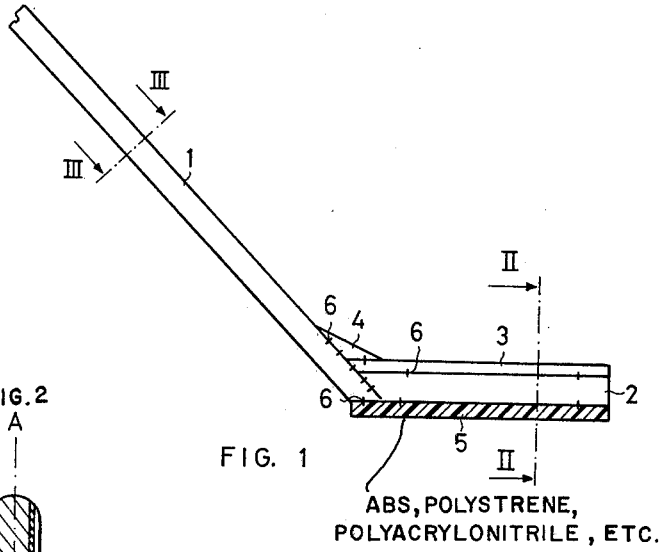
FIG. 1
FIG. 2
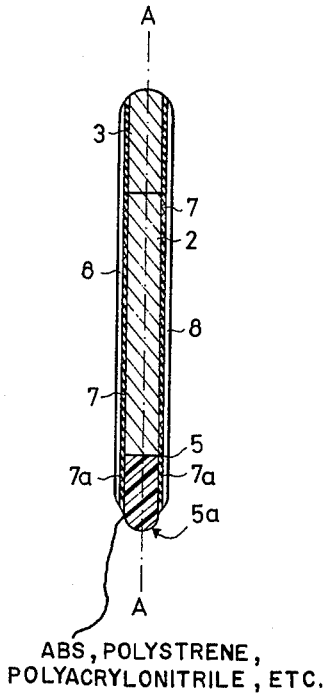
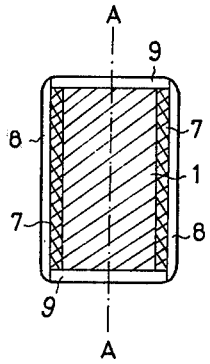
FIG. 3

STICK FOR HOCKEY OR THE LIKE

BACKGROUND OF THE INVENTION

The present invention relates to sticks to be used in games such as ice hockey or the like.

As is well known, sticks of this type receive the greatest amount of wear along the bottom edge of the blade, since this is the part of the stick which slides on the ice, for example. In the case where the blade has layers laminated to the side surfaces thereof, these layers are undesirably damaged at their bottom edges as the blade becomes worn during use thereof.

Thus, for example, it is known from Finnish patent No. 42,515, to make a stick of the above type from a number of core pieces which determine the dimensions such as the thickness of the stick. Reinforced plastic laminations are situated symmetrically on both sides of the core pieces and extend along the entire stick, with outer wood veneer courses being provided to protect the reinforced plastic laminations.

Experience has shown that such sticks indeed have high grade strength characteristics. However, the weakest point of such a stick has proved to be at the lower edge of the blade thereof, since this is the region which is exposed to wear. As an indirect consequence of the wear and tear which occurs at the lower edge of the blade, the reinforced plastic laminations, which are essential for the strength of the stick, are torn away from the core pieces at the lower region of the blade, thus resulting in destruction of the blade portion of the stick.

In addition, it is conventional when manufacturing sticks of this type to provide suitable joints between the plurality of core pieces. Joints such as tongue-and-groove joints are provided, for example. Thus, by way of such joints the core pieces are joined together to have a configuration corresponding to the final stick, and then layers such as reinforced plastic layers are laminated to the core pieces, with wood veneer or the like being laminated to the reinforced plastic so as to protect the latter.

However, procedures of this type require a considerable amount of time and labor particularly with respect to the joints between the several core pieces, thus increasing undesirably the cost of the stick.

SUMMARY OF THE INVENTION

It is accordingly a primary object of the present invention to provide a stick, and which will avoid the above drawbacks.

In particular, it is an object of the present invention to provide a stick of the above type with the possibility of being subjected to a considerable amount of wear and tear at the bottom edge region of the blade without causing the blade portion to become undesirably affected due to such wear and tear.

In particular, it is an object of the present invention to provide a stick capable of having considerable wear and tear at the lower edge of the blade without disturbing laminations at the sides of the blade.

Furthermore, it is an object of the present invention to provide a stick which can be manufactured in a considerably simplified and less expensive manner than has heretofore been possible.

Thus, in accordance with the invention the stick is composed of a series of core pieces which define the dimensions of the stick, with a particularly hard-wearing core piece made of plastic or an equivalent material, being situated along the lower edge of the blade part of the stick. The individual core pieces, prior to being laminated with the reinforced plastic layers, are assembled together while having only flat end surfaces, for example, engaging each other. Thus, there are no joints interconnecting the several core pieces. Instead it is possible to use for this purpose a suitable fastening means such as staples.

The thus-assembled core pieces are then laminated at their opposed side surfaces with reinforced plastic layers, and these layers may also be laminated with outer protective wood veneer layers.

However, at the bottom region of the blade the hard-wearing core piece extends downwardly beyond the reinforced plastic layers which are laminated thereto so that this particularly good wearing core piece forms the slidable ice-engaging part or skid extending continuously along the entire bottom edge region of the blade. In this way there will be no possible detachment of the lower edge regions of the reinforced plastic layers which are laminated to the blade.

BRIEF DESCRIPTION OF DRAWINGS

The invention is illustrated by way of example in the accompanying drawings which form part of this application and in which:

FIG. 1 is a side elevation showing an assembly of core pieces, the handle core piece being shown fragmentarily in FIG. 1;

FIG. 2 is in part a transverse section of the blade taken along line II—II of FIG. 1 in the direction of the arrows, FIG. 2 showing in addition exterior layers laminated to the core pieces; and FIG. 3 is in part a transverse section through the handle taken along line III—III of FIG. 1 in the direction of the arrows, and also showing in addition exterior layers laminated to the core piece.

DESCRIPTION OF PREFERRED EMBODIMENTS

The stick of the invention has a core made up of a plurality of core pieces as illustrated in FIG. 1. The core of the stick serves primarily to give the stick appropriate dimensions. In other words the core will determine such factors as the length and thickness of the handle and blade of the stick. However, the core has no substantial influence on the strength of the stick and is assembled from a plurality of core pieces of a relatively light material such as wood. Thus, FIG. 1 illustrates an elongated handle core piece 1 extending upwardly and rearwardly from a plurality of blade core pieces. These blade core pieces include an intermediate blade core piece 2, a lower blade core piece 5, which is a particularly hard-wearing core piece, and an upper blade core piece 3 extending along the upper edge of the intermediate core piece 2. The hard-wearing core piece 5 extends not only along the lower edge of the intermediate blade core piece 2 but also along the lower end of the handle core piece 1 so that the hard-wearing core piece 5 extends along the total length of the bottom edge of the blade. The upper elongated blade core piece 3 is made of a wood harder than the wood used for the core pieces 1, 2, and 4, while the particularly hard-wearing core piece 5 is made of a suitable plastic. Thus, the harder wood core piece 3 is situated at the top edge of the blade of the completed stick where it may be subjected to loads greater than the other core pieces, with the exception of the core piece 5. The core pieces further include a gusset core piece 4 at the junction between the upper blade core piece 3 and the handle core piece 1, as illustrated.

The hard-wearing core piece 5 situated along the lower edge of the blade is made of a material which has a high resistance to wear, such as ABS resin (acrylonitrile butadiene styrene) or other equivalent plastic materials such as polystyrenes or other polyacrylonitriles and copolymers thereof.

In accordance with one of the features of the present invention, the several core pieces are not joined together by any durable joint structures prior to being laminated with the reinforcing plastic layers 7. Thus, for example, the several core pieces are not connected one to the next by way of joints such as tongue-and-groove joints. Instead they simply have flat end surfaces directly engaging each other. The several core pieces are merely preliminarily fixed to each other and held together, prior to the pressing operation, by a suitable fastening means extending across the regions where the end surfaces of the core pieces engage each other. In the illustrated example the several core pieces are preliminarily fixed to each other by way of suitable staples 6. As a result the several core pieces are exceedingly simple and inexpensive to manufacture and the assembly thereof prior to being laminated with the exterior layers is also exceedingly simple and inexpensive.

In a manner which is already known, from Finnish Pat. No. 42,515, the core formed by the several pieces 1–5 illustrated in FIG. 1, is overlayed by pressing, with suitable heat, if necessary, reinforced plastic layers against the opposed side surfaces of the core. Thus, the several core pieces 1–5 form a core having a pair of opposed parallel side surfaces situated respectively in parallel planes where the reinforced plastic layers 7 are located so that they can thus be laminated to the opposed side surfaces of the core, these reinforced plastic layers 7 extending along the entire length of the handle and blade. Thus, it will be seen from FIGS. 2 and 3, that the reinforced plastic layers 7 are situated equidistant from the central plane of symmetry A—A of the blade and handle. The reinforced plastic layers which are thus respectively situated at the opposed side surfaces of the handle and blade extend along the entire length and width of the handle and blade, in a manner indicated in FIGS. 2 and 3. These reinforced plastic layers 7 are themselves protected by way of veneer layers 8 which may be made of a suitable wood veneer, and preferably the protective wood veneer layers 8 are laminated to the exterior of the reinforced plastic layers 7 simultaneously with the lamination of the latter layers 7 to the core.

It will be noted that with such an arrangement the front and rear surfaces of the handle core piece 1 will be exposed. These surfaces are covered by additional wood veneer layers 9 illustrated in FIG. 3, although the veneer layers 9 as well as the veneer layers 8 may be replaced by equivalent layers of plastic, for example.

It is to be noted that with this construction the stick has only two layers of reinforced plastic 7, each extending along the entire length of the handle and blade, so that the strength of the stick results from this construction.

Thus, during the manufacturing method of the invention the several core pieces are cemented together in such a way that each core piece is connected with the next core piece in one and the same operation with the connection to the reinforced plastic layers. In other words the bonding to the reinforced plastic layers provides the primary connection between the several core pieces.

Moreover, when the reinforced plastic layers are machined or otherwise formed to the required size and configuration, care is taken to provide for the reinforced plastic layers at their regions which extend along the blade a width according to which the hard-wearing core piece 5 will extend downwardly beyond the reinforced plastic layers 7. Thus, these layers 7 do not extend all the way to the lower edge of the core piece 5 so that the latter is exposed to form a wear-resistant continuous bottom skid for the blade, thus providing under any and all circumstances a wear-resistant sliding surface 5*a* (FIG. 2) between the blade and the ice. In this way the lower edges of the structural reinforced plastic laminations 7, at the blade, are prevented from being detached from the rest of the structure.

Thus, with the construction of the present invention, the stick is made up of different components which respectively serve precisely defined specific purposes. The several core portions 1–4 are made of wood or other sufficiently light material so as to maintain the structural reinforced plastic layers 7 at an appropriate distance from each other to achieve an adequate stiffness for the stick. The plastic or wood layers 8 protect the reinforced plastic layers 7 against scratches and abrasion. The bottom skid formed by the lower part of the core piece 5 which is made of a wear-resistant material absorbs the impacts between the stick and the ice and protects the bottom of the blade against wear and tear. This bottom blade core piece 5 together with the reinforced plastic layers 7, extending along the sides of the blade, constitute a bracing structure of U-shaped cross-section. Moreover it will be seen that a further important feature of the invention resides in the fact that the bottom skid 5 has a length equal to the total length of the entire blade.

It is also possible to provide a stick of the invention with a construction at the handle, either over the entire length thereof or least at its lower end region, according to which the handle core piece has laminated thereto the reinforced plastic layers 7 not only at the opposed side surfaces of the handle but also at the front and rear surfaces thereof where the veneer layers 9 are illustrated in FIG. 3. Thus, reinforced plastic layers will extend transversely of the plane of symmetry A—A as well as parallel thereto. As a result the handle will have a box-like bracing structure surrounding and laminated to the core, providing for the bracing structure a substantially rectangular cross-sectional shape surrounding the core portion of the handle.

The reinforced plastic layers 7 may be composed e.g. of the following materials: polyester resin or epoxy resin with the following reinforcement fibers: glass fibers, carbon fibers, borax fibers, or organic polyamid fiber.

What is claimed is:

1. A stick for use in ice hockey or equivalent games, comprising an inner core and outer layers of reinforced plastic laminated with said core, said core including a plurality of core pieces which together with said layers form an elongated handle and a blade situated at the bottom end of said handle, and said core pieces including an elongated core piece of hard-wearing material extending along the bottom of the blade for directly engaging ice or the like, said hard-wearing core piece extending downwardly beyond layers laminated thereto so that the latter core piece is exposed at the bottom edge region of the blade, whereby upon wearing of said hard-wearing core piece the layers laminated thereto will not be affected, the layers laminated to said hard-wearing core piece extending upwardly beyond the latter to form therewith a bracing structure of substantially U-shaped cross section, and said blade including a blade core piece extending along and engaging an upper edge of said hard-wearing core piece and situated between and being laminated with said layers which are laminated to and extend upwardly beyond said hard-wearing core piece, so that the latter layers are laminated to and overlap both said hard-wearing core piece and said blade core piece while extending across said upper edge of said hard-wearing core piece where the latter engages said blade core piece, said hard-wearing core piece extending along the entire length of the lower edge of the blade.

2. The combination of claim 1 and wherein said core pieces respectively have flat end surfaces engaging each other and said core pieces being held together primarily by said layers laminated thereto.

3. The combination of claim 2 and wherein a plurality of fastening means extend across junctions between the end surfaces of the assembled core pieces for fastening them to each other.

4. The combination of claim 3 and wherein said plurality of fastening means are in the form of staples.

5. The combination of claim 1 and wherein said layers of reinforced plastic have outer protective veneer layers laminated thereto.

6. The combination of claim 5 and wherein said veneer layers are made of wood.

7. The combination of claim 1 and wherein said core pieces include in addition to said hard-wearing core piece, an elongated handle core piece extending upwardly from a rear portion of said hard-wearing core piece at said upper edge thereof and said blade core piece engaging and extending forwardly from said handle core piece.

8. The combination of claim 7 and wherein said blade core piece forms an intermediate blade core piece, and said core pieces further including an upper blade core piece, with said intermediate blade core piece being situated between and engaging said upper blade core piece and said hard-wearing core piece, said upper blade core piece engaging and extending forwardly from said handle core piece along an upper edge of said intermediate blade core piece, and said core pieces further including a gusset core piece at the junction between and engaging said handle core piece and said upper blade core piece, said layers being laminated to and engaging at least opposed side surfaces of all of said core pieces.

9. The combination of claim 8 and wherein all of said core pieces respectively have said opposed side surfaces situated in a pair of common parallel planes and said reinforced plastic layers being respectively situated in said planes.

10. The combination of claim 9 and wherein said handle core piece has front and rear surfaces, and veneer layers laminated to said front and rear surfaces of said handle core piece.

11. The combination of claim 1 and wherein said hard-wearing core piece is made of a material selected from the group consisting of acrylonitrile butadiene styrene, polystyrene, polyacrylonitriles, and copolymers thereof.

12. The combination of claim 1 and wherein said hard-wearing core piece is made of acrylonitrile butadiene styrene.

* * * * *